US006954969B1

(12) United States Patent
Sprehe

(10) Patent No.: US 6,954,969 B1
(45) Date of Patent: Oct. 18, 2005

(54) RECLOSABLE FASTENER STRIP

(75) Inventor: Gregory S. Sprehe, Carbondale, IL (US)

(73) Assignee: Com-Pac International, Inc., Carbondale, IL (US)

( * ) Notice: Subject to any disclaimer, the term of this patent is extended or adjusted under 35 U.S.C. 154(b) by 436 days.

(21) Appl. No.: 10/054,203

(22) Filed: Nov. 13, 2001

Related U.S. Application Data

(63) Continuation-in-part of application No. 09/524,439, filed on Mar. 14, 2000, now Pat. No. 6,576,278.

(51) Int. Cl.[7] ..... B65D 33/24

(52) U.S. Cl. ..... 24/399; 24/400; 24/585.12; 24/384; 24/389; 24/30.5 R; 383/63; 383/64; 383/65; 383/5

(58) Field of Search ..... 24/399, 400, 30.5 R, 24/585.12, 384, 389, 572.1; 383/63, 64, 65, 383/5

(56) References Cited

U.S. PATENT DOCUMENTS

| | | | | |
|---|---|---|---|---|
| 3,117,874 A | | 1/1964 | Horan | |
| 3,173,184 A | * | 3/1965 | Ausnit | 24/399 |
| 3,204,855 A | | 9/1965 | Boynton | |
| 3,672,122 A | | 6/1972 | Berger et al. | |
| 3,742,950 A | | 7/1973 | Endrody | |
| 3,776,408 A | | 12/1973 | Wald | |
| 3,790,017 A | | 2/1974 | Fitzpatrick et al. | |
| 3,822,806 A | | 7/1974 | Grimes | |
| 4,201,299 A | | 5/1980 | Bumgarner et al. | |
| 4,238,040 A | | 12/1980 | Fitzpatrick | |
| 4,339,046 A | | 7/1982 | Coen | |
| 4,466,547 A | | 8/1984 | Klittich | |
| 4,501,585 A | | 2/1985 | Friedman | |
| 4,523,377 A | | 6/1985 | Spletzer et al. | |
| 4,558,792 A | | 12/1985 | Cabernoch et al. | |
| 4,600,104 A | | 7/1986 | Yanase | |
| 4,686,814 A | | 8/1987 | Yanase | |
| 4,711,359 A | | 12/1987 | White et al. | |
| 4,731,911 A | * | 3/1988 | Gould | 24/585.12 |
| 4,869,912 A | | 9/1989 | McCoy et al. | |
| 4,919,983 A | | 4/1990 | Fremin | |
| 4,923,701 A | * | 5/1990 | VanErden | 383/63 |
| 4,944,418 A | | 7/1990 | Wallace | |
| D310,417 S | | 9/1990 | Herritz | |
| D315,601 S | | 3/1991 | McCoy et al. | |

(Continued)

FOREIGN PATENT DOCUMENTS

| | | |
|---|---|---|
| DE | 3727321 | 3/1989 |

(Continued)

*Primary Examiner*—Victor Sakran
(74) *Attorney, Agent, or Firm*—Vedder, Price, Kaufman & Kammholz, P.C.

(57) ABSTRACT

A reclosable fastener strip for securing to a film web comprises first and second flangeless, elongated profile strip having a plurality of interlocking hooks, recesses and protuberances. Each hook, as extruded, has a half arrowhead-shaped tip, a concave or partial-concave tail, and a generally upstanding neck connecting the tip and tail. Each recess has a base with a pair of generally upstanding neck elements disposed on opposite ends of the base. The base does not extend laterally beyond the neck elements. Each protuberance, as extruded, has a rounded tip, a concave or partial-concave tail, and a generally upstanding neck portion connecting the tip and tail. The profile strips are readily secured to the web without entrapping air between the profile strips and the film web and form an airtight and watertight seal. The interlocking hooks, recesses and protuberances are dimensioned to provide and airtight and watertight seal upon interconnection thereof.

25 Claims, 3 Drawing Sheets

U.S. PATENT DOCUMENTS 5,020,680 A 6/1991 Bale
5,067,822 A * 11/1991 Wirth et al. ..... 383/63
5,167,657 A 12/1992 Patel
5,356,222 A * 10/1994 Kettner et al. ..... 383/63
5,385,251 A 1/1995 Dunn
5,403,094 A * 4/1995 Tomic ..... 383/63
5,435,864 A 7/1995 Machacek
5,509,734 A * 4/1996 Ausnit ..... 383/63
5,839,831 A * 11/1998 Mazzocchi ..... 383/65
5,983,965 A 11/1999 Patrick
6,004,032 A * 12/1999 Kapperman et al. ..... 383/5
6,050,432 A 4/2000 Koehnke
6,328,082 B1 12/2001 Lafond

FOREIGN PATENT DOCUMENTS

EP 0332341 9/1989

* cited by examiner

RECLOSABLE FASTENER STRIP

RELATED APPLICATION DATA

This application is a continuation-in-part application of Ser. No. 09/524,439 filed on Mar. 14, 2000 now U.S. Pat. No. 6,576,278 entitled "Reclosable Baby Bottle Liner and Baby Bottle having Reclosable Liner" and assigned to the same assignee, Com-Pac International, Inc.

FIELD OF INVENTION

This invention generally relates to baby bottle liners, baby bottles, and a baby bottle having a reclosable plastic liner with properties that permit the liner to be reused.

The present invention more specifically relates to a reclosable fastener for resealably closing a bag such as a baby bottle liner and to a fastener comprising a plurality of interlocking hooks, recesses and protuberances dimensioned and arranged to create a substantially airtight and watertight seal for such bags.

BACKGROUND OF INVENTION

Plastic film bags with reclosable fasteners are in widespread use in many industries and the home. The separable and reclosable fastener provides a convenient means for access into the bag and allows the bag to be reused.

Nursing pouches and disposable baby bottle liners provide a convenient way for nursing, working mothers to provide nourishment and sustenance for newborns and growing babies. Current baby bottle liners do not provide a way to safely store breast milk while minimizing the risk of external contamination of the milk, and internal bacterial growth. One such exemplary prior art baby bottle and liner is disclosed in U.S. Pat. No. 5,385,251 ("the '251 patent"). The '251 patent describes a baby bottle liner that provides a reclosable feature at one end of the liner. A serious drawback of this prior art patent involves the risk of contamination of the contents of the liner at the ends of the reclosable fastener and through the fastener itself. The liner of the '251 patent permits contamination by microbes through the sides of the fastener which are open to the environment. Further, the fastener itself permits air and water to enter the inside of the liner and contaminate the contents thereof. Consequently, a nursing mother may be feeding her child breast milk that may be contaminated with microbes which could cause serious gastrointestinal problems for the child.

Further, the prior art does not solve the problem of how to place an airtight and water tight reclosable string fastener on a liner that is of a size of most liners for baby bottles. Conventional baby bottle liners are generally narrow in width. Hence, placement and sealing of a reclosable fastener onto a liner of narrow width is also a serious problem.

Reclosable fasteners have been the subject of considerable development throughout the years, as is evidenced by the volumes of patents covering these devices. A common reclosable fastener construction consists of a single rib and corresponding groove assembly. The rib terminates into a generally asymmetric arrowhead-shaped, member commonly referred to as the male end of the fastener. The corresponding groove, commonly called the female end of the fastener, ordinarily consists of walls terminating into hooks for grabbing the rib and interlocking the fastener.

This construction offers many advantages, as well as disadvantages. For instance, the fastener elements can be easily and economically manufactured by extrusion methods. The fastener is also securely retained in the closed position to prevent the entrance of air or the discharge contents of the bag. The flanges readily open from the outside by applying a separating force on the pull flanges extending from the mouth of the bag. The key disadvantage of the single rib and groove construction is that unless the fastener components have a certain size or stiffness and are manufactured to closely adhering to strict tolerances, the fastener elements are difficult to align and interlock.

This disadvantages has been overcome by constructing a separable fastener with a plurality of interlockable hook-shaped ribs which can be small in size and composed of a relatively soft and resiliently flexible material that can be aligned and interlocked by simple inward pressure. However, this construction requires at least one of the hook-shaped ribs be hinged to the bag wall to prevent the fastener from opening by internal pressure.

Therefore, a first aspect of the present invention is to provide a reclosable fastener having the advantage of multi-rib and groove construction to facilitate alignment and interlocking engagement of fastener elements and which provide a substantially airtight and watertight seal.

Another aspect of the present invention is to provide a reclosable fastener which provides ample resistance to internal separating forces without requiring complex structures manufactured into the fastener elements.

A further advantage of the present invention is to provide a substantially flangeless reclosable fastener which is both substantially watertight and airtight and yet small in size, which reduces plastic usage and cost and allows use of watertight reclosable fasteners in relatively small flexible containers.

SUMMARY OF INVENTION

The present invention pertains to a reclosable fastener that resealably closes a bag. The bag comprises opposing panels, each having an inner surface, and the fastener is adapted to be affixed to the upper portions of the inner surfaces of the bag panels.

The fastener comprises a first continuous, elongated, profile strip with first and second adjacent hooks disposed thereon. The first hook is disposed at an end of the profile strip and the second hook is located proximal to the first hook. A second continuous, elongated, profile strip has first and second adjacent hooks disposed thereon. The first hook is disposed at an end of the profile strip and the second hook is located proximal to the first hook.

A plurality of continuous recesses are located along a length of each of the first and second profile strips. At least one of the recesses is dimensioned to resealably mate with one of the first or second hooks on the opposing profile strip forming an airtight and watertight seal. At least one continuous recess on each of the first and second profile strips is not dimensioned to mate with the hooks. In another variant of the present inventive reclosable fastener, at least two of the continuous recesses are dimensioned to resealably mate with the hooks. The hooks, as extruded, have a half arrowhead-shaped tip, a concave tail, and a generally upstanding neck connecting the tip and tail. The recesses have a base with a pair of generally upstanding necks disposed on opposite ends of the base. The base does not extend beyond the necks. In a preferred embodiment the fastener is substantially flangeless and is small in size, i.e., a "string zipper" without lateral sealing flanges for sealing the fastener to a bag wall. The fastener readily secures to the bag walls without entrapping air between the fastener and bag walls and forms and airtight and watertight seal.

DETAILED DESCRIPTION OF DRAWINGS

Figure 1:
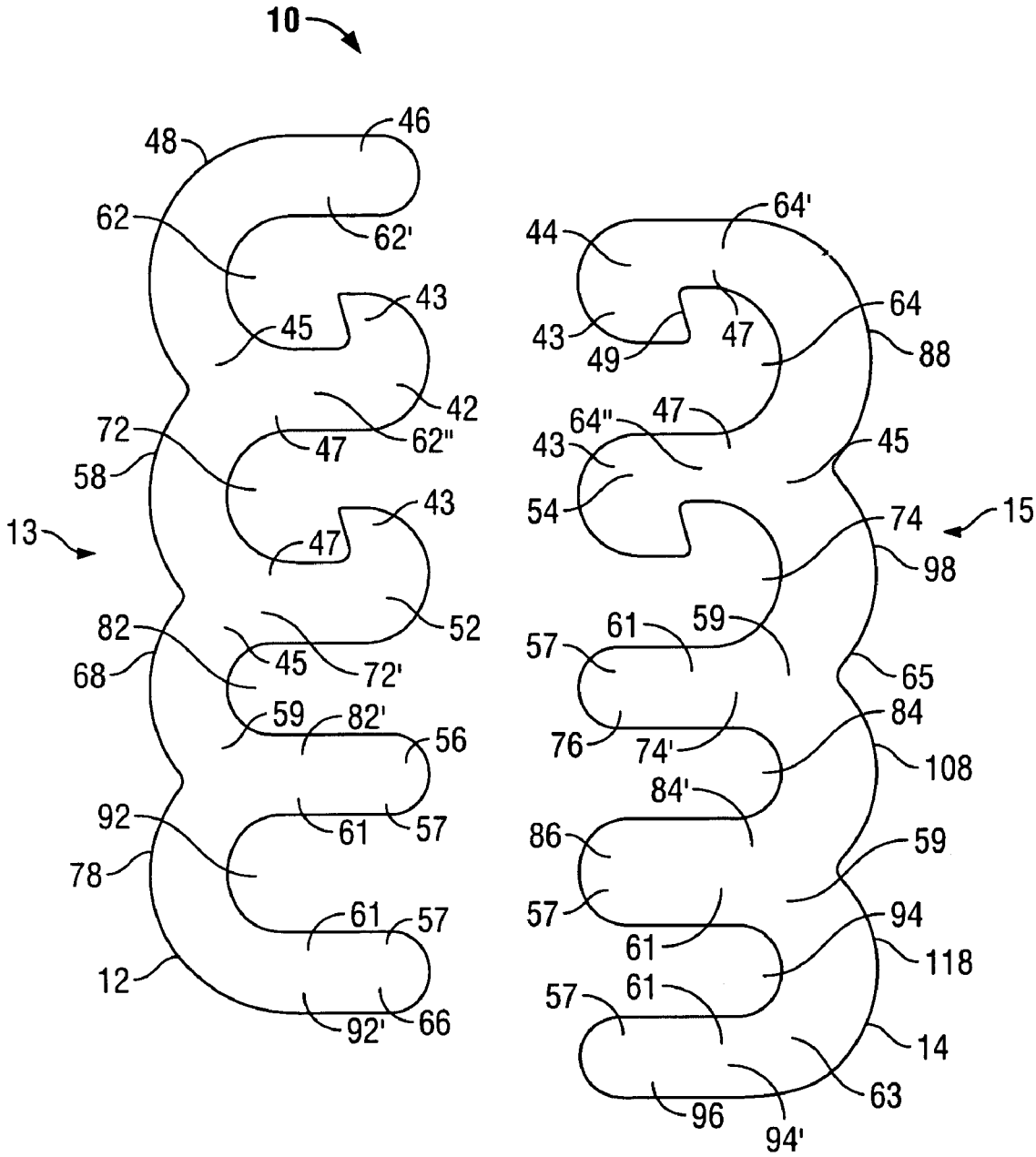
FIG. 1 is a side cross-sectional view of a continuous, profiled, elongated reclosable fastener that is a flanged reclosable fastener.

FIG. 1 shows a continuous, profiled, elongated reclosable fastener 10 according to the present invention. The fastener 10 includes a first continuous elongated profile strip 12 and a second continuous elongated profile strip 14. The fastener 10 is readily secured to the inner surfaces of a bag 16 (FIG. 2) without entrapment of air between the fastener elements and the bag 16. Reclosable plastic containers may be formed utilizing the disclosed fastener.

Figure 2:
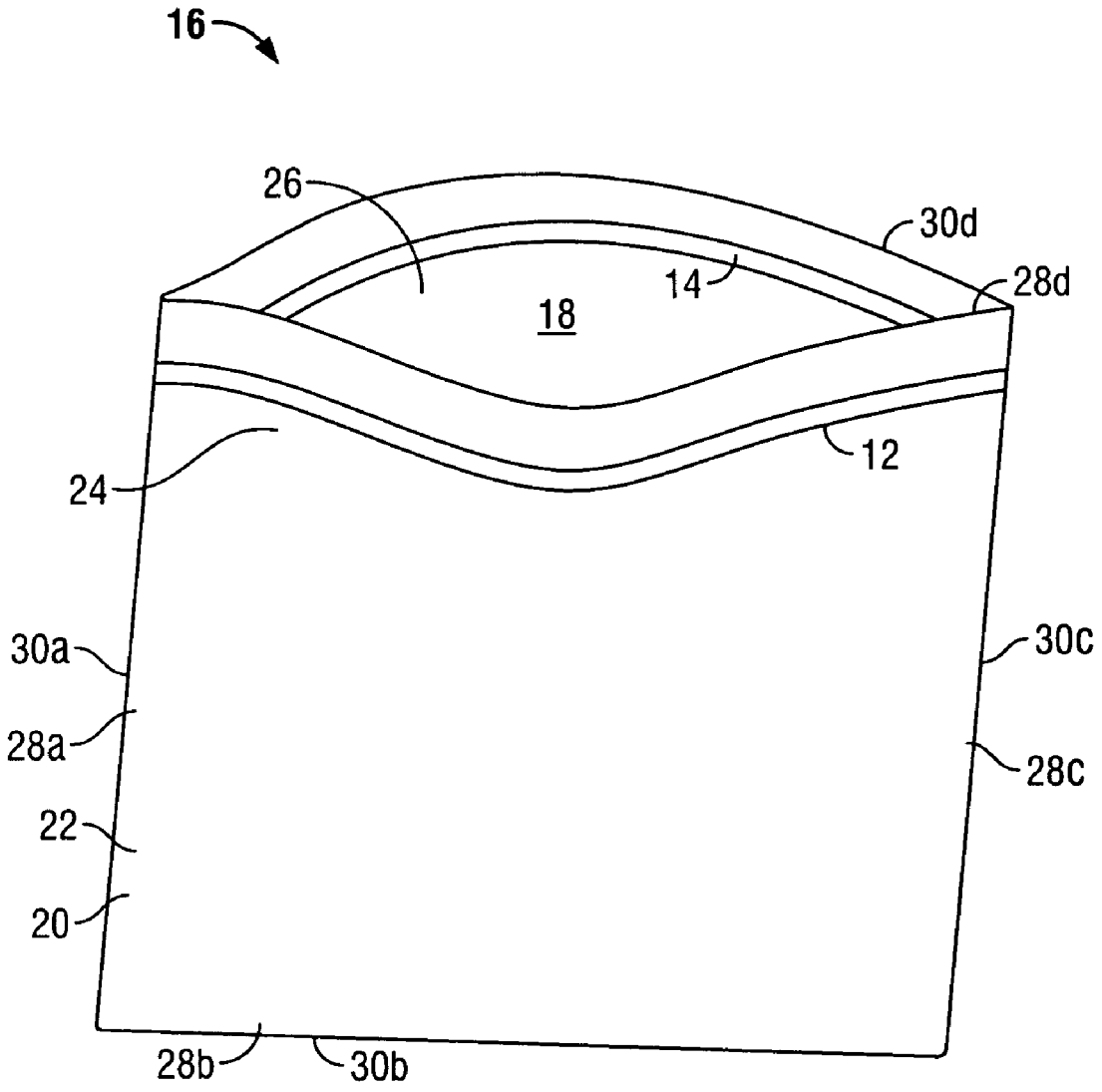
FIG. 2 shows a plastic film bag having reclosable separable fastener structure embodying the present invention.

The bag 16 may be fabricated from any suitable plastic film or sheet material, as is commonly known in the art. The bag 16 has a pouch 18 including opposing wall panels 20, 22 with inner surfaces 24, 26. The wall panels are defined by a first 28*a*, 30*a*, second 28*b*, 30*b*, third 28*c*, 30*c* and fourth 28*d*, 30*d* edges. The bag 16, shown in FIG. 2, is formed by folding a single sheet into two wall panels 20, 22, wherein the side edges of the panels 28*a*, 30*a*, 28*c*, 30*c* may be closed by heat seal. Alternatively, the wall panels 20, 22 may be two separate pieces where the first 28*a*, 30*a*, second 28*b*, 30*b*, and third 28*c*, 30*c* edges are heat sealed to form the pouch 18.

The fourth edges 28*d*, 30*d* provide an access opening to the pouch 18. The profile strips 12, 14 are affixed to the upper portions of the inner surfaces 24, 26 of wall panels 20, 22 to close and seal the bag 16 from the exterior environment. Preferably, the profile strips 12 and 14 are sealed on their rear surface 13 and 15 to inner surfaces 24 and 26 by means of heat sealing. The segments 32, 34 distal to the to the profile strips 12, 14 act as pull flanges for opening the fastener assembly 10 (FIG. 1).

An important aspect of the invention is the fact that the first continuous elongated profile strip 12 and the second continuous elongated profile strip 14 are dimensioned to provide an airtight and watertight seal upon interconnection thereof. The airtight and/or watertight seal provide the important function of keeping foreign material including bacteria, molds, and viruses from entering the pouch 18. Further, this seal starves any bacteria or other microbes inside the contents of the pouch of oxygen, thus destroying the ability to replicate exponentially. Hence, the risk of contamination of the pouch's contents is greatly reduced.

A further advantage of the present invention is to provide a substantially flangeless reclosable fastener 10 which is both substantially watertight and airtight and yet small in size, which reduces plastic usage and cost and allows use of watertight reclosable fasteners in relatively small flexible containers.

The present inventive reclosable fastener 10 has been found to provide a particularly durable airtight and watertight seal. Fastener 10 includes first continuous elongated profile strip 12 and second continuous elongated profile strip 14 each having at least two hooks 42, 52, 44, 54 thereon. First continuous elongated profile strip 12 has hooks 42, 52; second continuous elongated profile strip 14 has hooks 44, 54 hooks thereon. While only two pairs of hooks 42, 52 and 44, 54 are constructed and arranged on the profiles 12, 14 in the variant shown in FIG. 1, it is appreciated that a greater or lesser number of hooks can be used as desired, with a corresponding increase/decrease in width of the strips 12, 14.

Preferably hooks 42, 52 on the first continuous elongated profile strip 12 and hooks 44, 54 on the second continuous, elongated profile 14, as extruded, are of equal height and have a half arrowhead-shaped tip 43, a concave tail 45, and a generally upstanding neck 47 connecting the hip and tail. Hooks 42, 52 are adjacent to each other on the first profile strip 12. Optionally, the hooks 44, 54 on second profile strip 14 are also adjacent to each other in one variant of the invention. At least one hook 44 is at an end of the first continuous elongated profile strip 12. The second hook 54 is located proximal to hook 44. It is appreciated that a hook 44 formed at an end of a profile strip will have a partially-concave tail segment 49.

In one variant of the invention, the first continuous, elongated profile strip 12 has a plurality of continuous recesses 62, 72, 82, 92 along a length of the strip. The second continuous, elongated profile strip 14 has a plurality of continuous recesses 64, 74, 84, 94 along a length of the strip. A plurality of neck segments 62', 62", 72', 82' and 92' are disposed along base segment 64 and define recesses 62, 72, 82 and 92 along the first profile strip 12. Likewise, neck segments 64', 64", 74', 84' and 94' are disposed along base segment 65 and define recesses 64, 74, 84 and 94 along the second profile strip 14. The base segments 63, 65 do not extend beyond the neck segments 62', 92' and 64', 94' located at the opposite ends of each base segment. In other words, the fastener is flangeless; no lateral flanges are used to seal the fastener to the bag wall. Of course, it is appreciated that any number of recesses can be created along the first and second profile strips 12, 14, including but not limited to more than four recesses and less than four recesses, with a corresponding increase/decrease in corresponding hooks and other members. In one variant of the invention, at least one of the recesses is dimensioned to resealably mate with one of hooks. The recesses 62, 72 are substantially congruent to hooks 44, 54 such that releasably interlocking the hooks into the recesses creates a secure airtight and watertight seal. Similarly, recesses 64, 74 are substantially congruent to hooks 42, 52 such that releasably interlocking hooks 42, 52 into recesses 64, 74 creates a secure airtight and watertight seal. It is appreciated that the present invention provides a reclosable fastener with a plurality of airtight and/or watertight seals between corresponding members of the profile strips 12, 14.

It is further appreciated that, preferably, at least two continuous recesses 62, 72 are dimensioned to resealably mate with hooks 44, 54, and continuous recess 74, is dimensioned to resealably mate with hooks 52.

In another variant of the invention, at least one continuous recess on each respective profile strip is not dimensioned to mate with a respective hook, but rather dimensioned to tightly fit into a recess that is substantially congruent to a profile member. It is appreciated that when first protuberance member 56 is inserted into recess 84, the tight fit between the first protuberance member 56 and the recess 84 also creates an additional substantially airtight and watertight seal. The interaction between the other recesses and members causes a similar result with the combination of the interaction of the various hooks, recesses, and members creating a substantially leak-proof failsafe seal. Of course, it is further appreciated that while the geometry of the members as shown in FIG. 1 is of a mono-hooked rib geometry, any type of geometry or configuration can be used, e.g., a rectangular geometry, a triangular geometry, etc. The fastener 10 of the present invention provides for at least one protuberance along a length of each of the first and second profile strips 12, 14 dimensioned to fit securely in one of the continuous recesses on each of the profile strips, and not dimensioned to mate with one of the hooks 42, 52, 44, 54. In the present embodiment, the first protuberance member 56, second protuberance member 66, third protuberance member 76, fourth protuberance member 86 and fifth protuberance member 96, as extruded, have a rounded tip 57, a concave tail 59, and a generally upstanding neck 61 connecting the tip and tail. The tip is dimensioned to snuggly communicate with a corresponding recess to add to airtight and watertight qualities of the fastener 10. It is also appreciated that a protuberance 96 formed at the end of a profile strip will have a partially concave tail 63.

As further seen in FIG. 1, a plurality of ridges 48, 58, 68, 78, 88, 98, 108, 118 are located on the back sides of each of the first and second profile strips 12, 14. Ridges 48, 58, 68, 78, 88, 98, 108, 118 provide a suitable way to obtain an airtight and watertight seal of back sides of the first and second profile strips 12, 14 to the inside surfaces 24, 26 (FIG. 2) of panels 20, 22 (FIG. 2).

Figure 3:
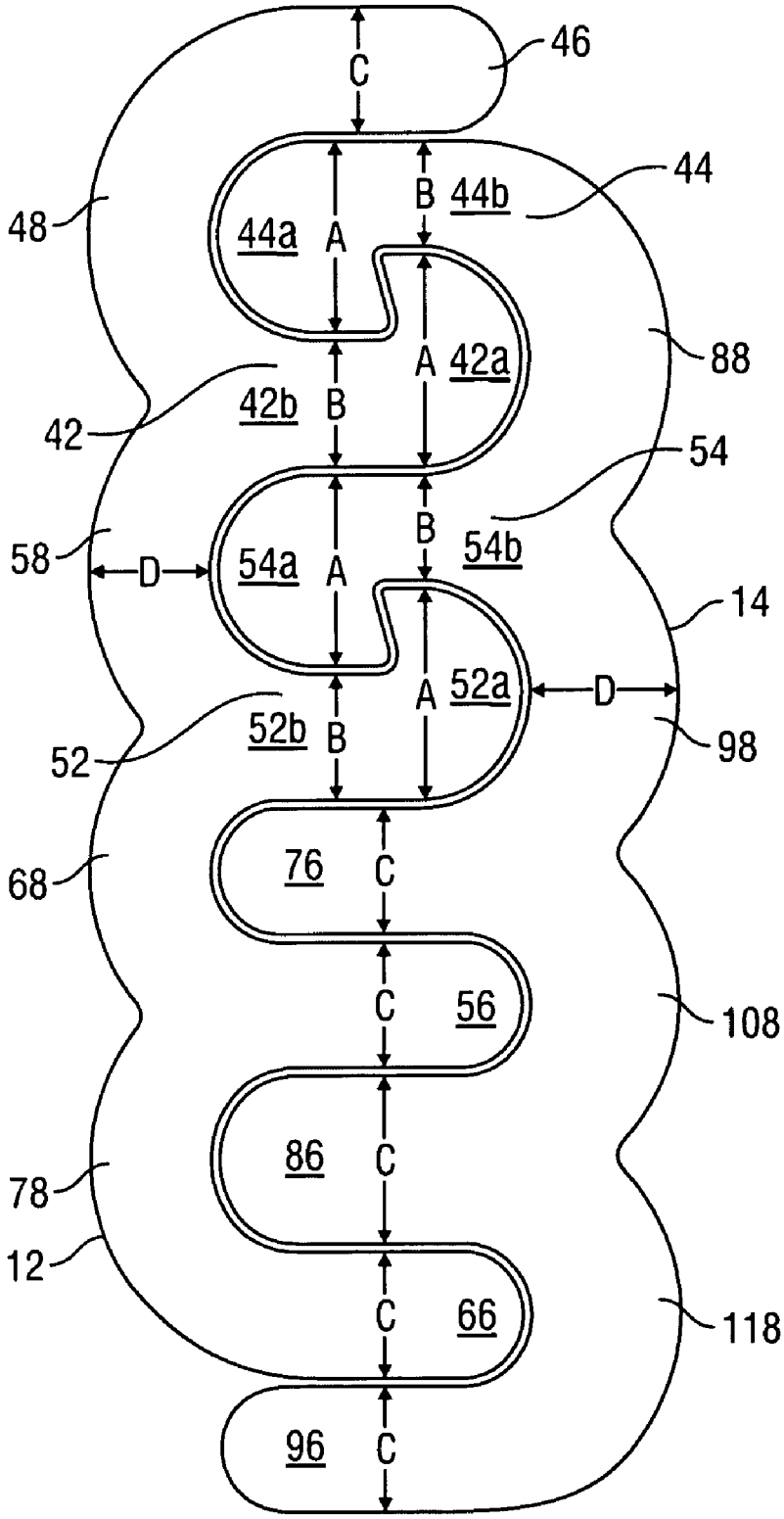
FIG. 3 is a dimensioned side cross-sectional view of the continuous, profiled, elongated reclosable fastener of FIG. 1.

FIG. 3 shows a dimensioned reclosable fastener strip in accordance with a preferred embodiment of the present invention. Hooks 42, 44, 52 and 54 have a head portion 42*a*, 44*a*, 52*a*, and 54*a*, each having a cross-sectional dimension A, and a neck portion 42*b*, 44*b*, 52*b* and 54*b*, each having cross-sectional dimension B. Protuberance members 46, 56, 66, 76, 86 and 96 each have dimension C and ridges 48, 58, 68, 78, 88, 98, 108 and 118 each have dimension D. Table 1 shows the preferred values for measurements A, B, C, D:

TABLE 1

| Label | Measurement (inches) |
|---|---|
| A | 0.024 ± 0.0024 |
| B | 0.018 ± 0.0018 |
| C | 0.013 ± 0.0013 |
| D | 0.019 ± 0.0019 |

Table 1 expresses values A, B, C and D as ranges to take into account for manufacturing tolerances.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

It is appreciated that while the geometry and arrangement of the various recesses and hooks described herein generally relates to a hook and a substantially congruent recess to the hook, a variety of suitable geometries or configurations of the male members and female members are disclosed subject only to the condition that the seal made when the profiles are interlocked is airtight and/or water tight.

I claim:

1. A reclosable fastener for resealably closing a bag with opposing wall panels, each wall panel having an inner surface, the fastener adapted to be affixed to the upper portions of the inner surfaces, the fastener comprising:

a first continuous, elongated, profile strip with first and second adjacent hooks disposed thereon, the first hook being disposed at an end of the profile strip and the second hook being located proximal to the first hook;

a second continuous, elongated, profile strip with first and second adjacent hooks disposed thereon, the first hook being disposed at an end of the profile strip and the second hook is located proximal to the first hook; and a plurality of continuous recesses disposed along the length of each of the first and second profile strips, at least one of the recesses being dimensioned to resealably mate with one of the first or second hooks on the opposing strip forming an airtight and watertight seal and at least one continuous recess on each of the first and second profile strip being dimensioned not to mate with the hooks.

2. The reclosable fastener of claim 1, wherein said first and second elongated profile strips are substantially without lateral sealing flanges.

3. The reclosable fastener of claim 2, wherein at least two of the continuous recesses are dimensioned to resealably mate with the hooks.

4. The reclosable fastener of claim 3, further comprising at least one protuberance along a length of each of the first and second profile strip and dimensioned to fit securely in the continuous recess on each of the first and second profile strip not dimensioned to mate with the hooks.

5. The reclosable fastener of claim 4, further comprising a plurality of ridges on a back side of each of the first and second profile strips.

6. The reclosable fastener of claim 5, wherein at least one of the hooks on the first profile strip is located near the center of the profile strip.

7. The reclosable fastener of claim 6, wherein the hooks are substantially symmetrically distributed on two sides of a center axis of the profile strip.

8. The reclosable fastener of claim 7, wherein the hooks are mono-hooked ribs of equal height.

9. The reclosable fastener of claim 1, wherein a head portion with a cross-sectional width of 0.024 inches±0.0024 inches and a neck portion with a cross-sectional width of 0.018±0.0018 inches comprise the first and second hooks on the first and second profile strips.

10. The reclosable fastener of claim 1, wherein at least one continuous recess on each of the first and second profile strips is formed by adjacent elongated members having a cross-sectional width of 0.013 inches±0.0013 inches.

11. The reclosable fastener of claim 1, further comprising:

a third and fourth recess on the first profile strip, the third recess being formed by the second hook and a first protuberance member and configured to receive a third protuberance member on the second profile strip, and the fourth recess being formed on the first profile strip by the first protuberance member and a second protuberance member and configured to receive a fourth protuberance member on the second profile strip;

a fifth recess on the second profile strip, the fifth recess being formed by the fourth and fifth protuberance members on the second profile strip and configured to receive the second protuberance member on the first profile strip;

wherein the protuberance members on the first and second profile strips have cross-sectional width of 0.013 inches±0.0013 inches.

12. The reclosable fastener of claim 11, wherein the plurality of ridges have cross-sectional width of 0.019 inches±0.0019 inches.

13. A reclosable strip fastener comprising:

a first continuous, elongated, profile strip with first and second adjacent hooks disposed thereon, the first hook being disposed at an end of the profile strip and the second hook being located proximal to the first hook; and a second continuous, elongated, profile strip with first and second adjacent hooks disposed thereon, the first hook being disposed at an end of the profile strip and the second hook is located proximal to the first hook;

a plurality of continuous recesses disposed along the length of each of the first and second profile strip, at least one of the recesses being dimensioned to resealably mate with one of the first or second hooks on the opposing strip forming an airtight and watertight seal and at least one continuous recess on each of the first and second profile strip being dimensioned not to mate with the hooks.

14. The reclosable fastener of claim 13, wherein said first and second elongated profile strips are substantially without lateral sealing flanges.

15. The reclosable fastener of claim 14, wherein at least two of the continuous recesses are dimensioned to resealably mate with the hooks.

16. The reclosable fastener of claim 15, further comprising at least one protuberance along a length of each of the first and second profile strip and dimensioned to fit securely in the continuous recess on each of the first and second profile strip not dimensioned to mate with the hooks.

17. The reclosable fastener of claim 16, further comprising a plurality of ridges on a back side of each of the first and second profile strips.

18. The reclosable fastener of claim 17, wherein at least one of the hooks on the first profile strip is located near the center of the profile strip.

19. The reclosable fastener of claim 18, wherein the hooks are substantially symmetrically distributed on two sides of a center axis of the profile strip.

20. The reclosable fastener of claim 19, wherein the hooks are mono-hooked ribs of equal height.

21. The reclosable fastener of claim 13, wherein a head portion with a cross-sectional width of 0.024 inches±0.0024 inches and a neck portion with a cross-sectional width of 0.018±0.0018 inches comprise the first and second hooks on the first and second profile strips.

22. The reclosable fastener of claim 13, wherein the at least one continuous recess on each of the first and second profile strip is formed by adjacent elongated members having a cross-sectional width of 0.013 inches±0.0013 inches.

23. The reclosable fastener of claim 13, further comprising:

a third and fourth recess on the first profile strip, the third recess being formed by the second hook and a first protuberance member and configured to receive a third protuberance member on the second profile strip, and the fourth recess being formed on the first profile strip by the first protuberance member and a second protuberance member and configured to receive a fourth protuberance member on the second profile strip;

a fifth recess on the second profile strip, the fifth recess being formed by the fourth and fifth protuberance members on the second profile strip and configured to receive the second protuberance member on the first profile strip;

wherein the protuberance members on the first and second profile strips have cross-sectional width of 0.013 inches±0.0013 inches.

24. The reclosable fastener of claim 17, wherein the plurality of ridges have cross-sectional width of 0.019 inches±0.0019 inches.

25. A reclosable fastener for resealably closing a bag with opposing wall panels, each wall panel having an inner surface, the fastener adapted to be affixed to the upper portions of the inner surfaces, the fastener comprising:

a first continuous, elongated, profile strip and a second, continuous elongated profile strip, each profile strip comprising a first hook having a half arrowhead-shaped tip, a concave tail, and a generally upstanding neck connecting the tip and tail and configured to form an airtight and watertight seal with a first recess on the opposing strip comprising a first and second generally upstanding neck disposed on opposite ends of a base that does not extend laterally beyond the first and second neck elements, and the first and second profile strip being configured to affix to the upper portions of the inner surfaces without entrapping air between the profile and the wall panel.

* * * * *